United States Patent [19]

Jenkins

[11] 4,102,006

[45] Jul. 25, 1978

[54] DOOR CLOSER

[75] Inventor: Albert Edward Jenkins, Lapworth, England

[73] Assignee: Perkins & Powell Limited, Birmingham, England

[21] Appl. No.: 717,878

[22] Filed: Aug. 26, 1976

[51] Int. Cl.[2] ..... E05F 3/04

[52] U.S. Cl. ..... 16/51; 16/66

[58] Field of Search ..... 16/49, 50, 54, 51, 58, 16/66, 68

[56] References Cited

U.S. PATENT DOCUMENTS

| | | | |
|---|---|---|---|
| 2,702,398 | 2/1955 | Marcus | 16/66 |
| 3,071,800 | 1/1963 | Patriquin | 16/66 |
| 3,072,954 | 1/1963 | Patriquin | 16/66 |
| 3,090,988 | 5/1963 | Truhon | 16/66 |
| 3,249,961 | 3/1966 | Quinn | 16/66 |
| 3,289,242 | 12/1966 | Mallory | 16/66 |
| 3,593,367 | 7/1971 | Waldo | 16/66 |

*Primary Examiner*—Ronald Feldbaum

*Attorney, Agent, or Firm*—Barlow & Barlow

[57] ABSTRACT

A door closer with integral check action comprising a rigid rod movable inwardly and outwardly of a tubular housing which is adapted to be mounted on a door. The rigid rod is pivotally connected to a rigid link plate itself pivotally connected to a fixing plate for mounting on the door frame. A spring within the housing urges the rod inwardly to close the door. On one side of a transverse wall, through which the rod extends, is a fluid filled chamber in which moves a piston, carried by the rigid rod. Valve means on the piston act to resist only inward movement of the piston as the door is closed by the force of said spring and the rate of closure of the door is thereby controlled without substantially restricting outward movement of the piston in response to opening of the door.

8 Claims, 2 Drawing Figures

DOOR CLOSER

BACKGROUND OF THE INVENTION

1. Field of the Invention

This invention relates to a door closer of the type comprising an element which is movable longitudinally of a tubular housing containing spring means acting on an abutment afforded by the element to urge the element inwardly of the housing, the element carrying at its outer end which projects from the housing an articulated connection with a fixing plate. Such door closers are hereinafter referred to as being of the kind specified.

It will be understood that door closers of the kind specified are fitted with said housing mounted on, or preferably received in, the door or a fixed part of the door frame, and the fixing plate is secured to a fixed part of the door frame or the door respectively, the arrangement being such that when the door is opened the element is pulled outwardly of the housing against the force of said spring means so that when the door is subsequently released the energy stored by the spring means acts to pull the element back inwardly of the housing, thus closing the door.

It will be understood that devices of this kind are not limited in their applicability solely to doors, and that they may be utilised additionally with windows or other, like, hinged panel structures which are movable about pivots towards and away from a position of closure relative to a complementary frame or like structure. Accordingly, throughout this specification the word "door" is used for convenience.

2. Description of the Prior Art

In previous door closers of the kind specified said element has been in the form of a chain usually of the type consisting of plate-like links connected together by rivets so that the chain as a whole is flexible in a single plane.

SUMMARY OF THE INVENTION

According to the invention we provide a door closer of the kind specified wherein said element comprises a rigid rod carrying a piston which is slidable in a fluid filled chamber defined by the housing, the chamber being divided into two compartments and incorporating valve means which permit relatively free movement of the fluid from one compartment to the other when the piston is moved in the door opening direction, but which, when the piston is moved in the door closing direction, affords sufficient resistance to movement of the fluid as to check the rate at which the rod is moved under the force of said spring means.

In one simple arrangement, the valve means may comprise a leaf spring arranged on the face of the piston directed away from the outer end of the rod to cover a bore which extends through the piston, which itself serves to divide the chamber into said two compartments.

Preferably, by-pass means are provided to operate over that part of the range of movement of the rod which corresponds to the final closure of the door to relieve such resistance in order to allow the force exerted by said spring means to overcome any additional resistance afforded by a latch or catch on the door.

The by-pass means may take the form of a local increase in the internal diameter of the housing, or a slot or groove formed in the internal face thereof. In an alternative arrangement, the fluid filled chamber may be defined between the abutment on the rod and the piston, and be divided into said compartments by a transverse wall through which the rod extends. In this case, the valve means would be provided on said wall, and the by-pass means could take the form of a groove formed in the rod at such a position as to allow fluid to flow past the transverse wall otherwise than under the control of said valve means.

Conveniently, said spring means comprises a compression spring, but alternatively it would be possible to employ compressed gas, in which case the abutment would comprise a further piston on which such compressed gas acts.

BRIEF DESCRIPTION OF THE DRAWINGS

The invention will now be described by way of example with reference to the accompanying drawings which illustrate one embodiment of door closer.

DESCRIPTION OF THE PREFERRED EMBODIMENT

Figure 1:
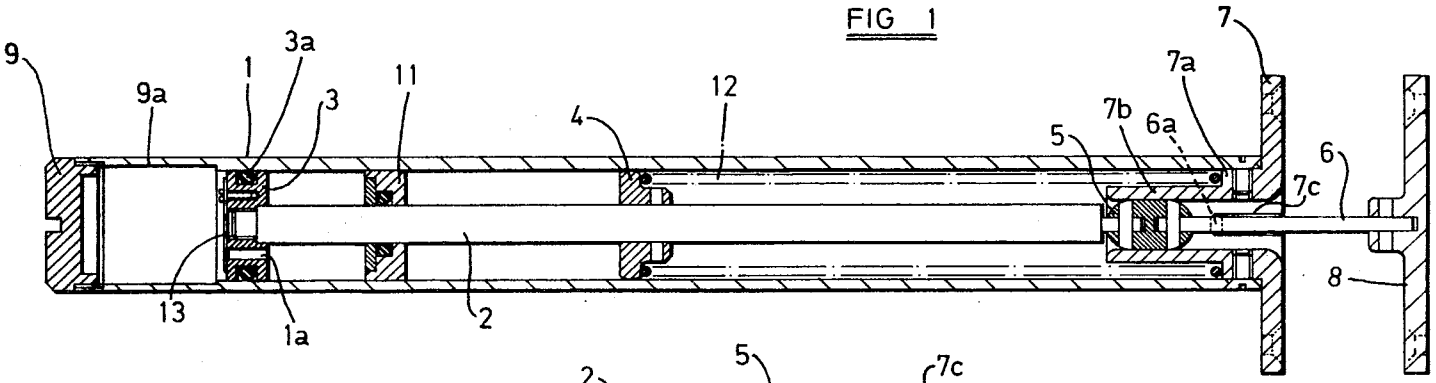
FIG. 1 shows a longitudinal section in a vertical plane.
Figure 2:
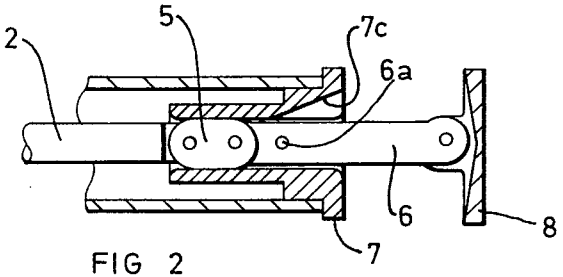
FIG. 2 shows a partial horizontal section at the outer end.

As illustrated, the door closer in accordance with the invention includes a tubular housing 1 which at its inner end is internally threaded to receive a plug 9. At its outer end, the tube 1 is secured to a fixing plate 7 by means of a pair of screws which enter a boss **7*a* protruding from the plate 7**.

A rod 2 extends co-axially within the housing 1 and carries at its inner end a piston 3 provided with an external sealing ring **3*a* to engage the interior face of the housing in fluid-tight manner. Intermediate its ends, the rod 2 carries a piston-like abutment 4 having an annular recess in the face which is presented outwardly of the housing 1. This recess accommodates one end of a compression spring 12 which at its other end is seated in a similar rabbet formed in the bush 7*a* at the junction with a reduced diameter part 7*b* thereof that serves as a guide for the rod 2. The abutment 4 is secured to the rod 2 by means of a transversely extending pin and it will therefore be apparent that the spring 12 acts on the rod 2 to press the latter towards the inner end of the housing 1**.

At its outer end, the rod 2 is pivotally connected to a knuckle 5 which is itself pivotally connected to a link 6. The latter is pivotally connected at its outer end to a fixing plate 8. To enable the door to be held in its open position if so desired, the link 6 may be formed with a hole **6*a* to receive a retaining pin (not shown) which will engage against the plate 7 and prevent withdrawal of the rod 2 under the action of spring 12**.

In use, the fixing plate 8 will normally be secured to an upright part of a door frame and the housing 1 will normally be recessed into the door itself and secured in position by means of the plate 7. However, if desired the components may be fitted the other way about. In operation, as the door is opened the rod 2 is pulled outwardly of the housing 1 and the spring 12 is compressed. When the door is released the spring 12 causes the rod 2 to withdraw into the housing 1 and thereby close the door. A groove **7*c* is formed at the mouth of the plate 7 through which the link 6 protrudes in order to allow the link to take up an angled position when the plates 7 and 8** are substantially perpendicular to one another.

In accordance with the invention the rate of closure of the door is controlled by flow of fluid across the piston 3. For this purpose, a transverse wall 11 is fixed within the housing 1 and the length of the housing between the plug 9 and the wall 11 defines a chamber filled with a suitable fluid, such as glycerine. The piston 1 is formed with a through bore 1*a* and carries a flat leaf spring 13 which obstructs one end of the bore. The arrangement is such that when the door is opened and the rod moves outwardly of the housing 1, the leaf spring 13 is lifted away from the piston by the pressure of the fluid within the compartment defined between the piston 3 and the transverse wall 11 so that there is no substantial increase in the resistance to the opening movement of the door, apart from that cause by the compression spring 12. However, when the door is released, inward movement of the rod 2 causes the pressure in the compartment defined between the piston 3 and the plug 9 to act on the leaf spring and hold it firmly over the end of the bore 1*a*. The leaf spring 13 is formed with a fine hole (not shown) in alignment with the bore 1*a* whereby fluid is allowed to pass through the bore at a controlled rate as the piston 3 moves inwardly towards the plug 9.

Preferably, the housing 1 is formed at its inner end with a portion 9*a* of slightly increased internal diameter so that when the rod 2 is almost fully retracted, the piston 3 enters the portion 9*a* of the housing and the clearance thus afforded at the periphery of the piston acts as a by-pass to allow the fluid to flow relatively freely so that the check action ceases.

In an alternative embodiment, the chamber containing the fluid could be defined between the piston 3 and the abutment 4, and in this case the latter would be provided with external sealing rings, and the transverse wall 11 would be formed with a through bore similar to the bore 1*a* and itself equipped with the leaf spring 13.

Although the fluid filled chamber has been shown disposed inwardly of the spring 12, it will be appreciated that these positions may be reversed. Thus, the spring 12 could act between an abutment at the inner end of the rod 2 and a transverse wall similar to wall 11, and such wall could define one end of the fluid filled compartment, the other, forward end of which could be defined by a similar further wall, the rod carrying an annular piston at a position between said two walls. This arrangement would have the advantage of maintaining the volume of the compartment constant despite inward and outward movement of the rod.

Further, the compression spring 12 may be replaced by other suitable spring means, such as a chamber of compressed gas in the manner previously mentioned, in which case a further transverse wall would be needed to confine the gas between the abutment 4 and said further wall.

In a further alternative arrangement, the compression spring 12 could be arranged within the fluid filled chamber itself to act between the transverse wall 11 and the piston 9, whereby a reduction in the overall length of the housing 1 could be achieved. However, the illustrated arrangement is preferred for simplicity of construction and ease of assembly.

I claim:

1. A door closer comprising, (a) a tubular housing, a bushing at one end, a rigid rod extending through the bushing and extending axially of the housing to be movable longitudinally of the housing, (b) resilient means for urging said rod inwardly of the housing, (c) fluid control means in said housing comprising a fluid filled chamber defined by the housing and a piston carried by said rod and slidable in said fluid filled chamber, the chamber being divided into two compartments and incorporating valve means between said compartments which permit relatively free movement of the fluid from one compartment to the other when the rod is moved outwardly of the housing but which when the rod is moved inwardly affords sufficient resistance to movement of the fluid as to check the rate at which the rod is moved under the force of said resilient means, (d) a fixing plate and articulated connecting means for connecting said plate to said rod, said connecting means comprising a rigid link.

2. A door closer as claimed in claim 1 wherein said rod has an abutment intermediate its ends and said resilient means act between said abutment and said bushing.

3. A door closer as claimed in claim 1 wherein the piston divides the chamber into two compartments and the valve means is in said piston.

4. A door closer as claimed in claim 3 wherein the valve means comprises a bore which extends through the piston and a leaf spring attached to the face of the piston to cover said bore.

5. A door closer as claimed in claim 1 wherein by-pass means are provided to operate over that part of the range of movement of the piston which corresponds to the final stage of inward movement of the rod to relieve such resistance in order to allow said resilient means to exert its full force to overcome any additional resistance afforded by a latch or catch on the door on which the closer is mounted when in use comprising an increase in the internal diameter of the fluid filled chamber defined by the housing adjacent the inner end.

6. A door closer as claimed in claim 1 wherein a transverse wall intermediate the ends of the housing is provided and the fluid filled chamber is defined between the inner end wall of the housing and said transverse wall through which said rod extends.

7. A door closer as claimed in claim 1 wherein said resilient means comprises a compression spring acting on an abutment carried by said rod.

8. A door closer as claimed in claim 1 wherein the bushing affords a mouth through which the rod moves and into which the rigid link extends when the rod is fully retracted into the housing, the mouth being formed with a lateral slot to enable the link plate to swivel about its connection with the rod into such slot into a position extending obliquely relative to the rod.

* * * * *